United States Patent [19]

Graham

[11] 4,103,495

[45] Aug. 1, 1978

[54] FLOW CONTROL DEVICE FOR AN IRRIGATION DITCH

[75] Inventor: Gordon L. Graham, Glasgow, Mont.

[73] Assignee: Richard Rhode, Glasgow, Mont. ; a part interest

[21] Appl. No.: 721,731

[22] Filed: Sep. 9, 1976

[51] Int. Cl.[2] ..... E02B 7/40; F16K 51/00

[52] U.S. Cl. ..... 61/12; 61/22; 137/147; 251/147; 251/299

[58] Field of Search ..... 61/12, 16, 17, 18, 29, 61/25, 28, 22; 251/147, 299; 137/147; 49/400, 398, 388, 40; 109/70, 64

[56] References Cited

U.S. PATENT DOCUMENTS

| | | | |
|---|---|---|---|
| 961,292 | 6/1910 | Fowler | 61/12 X |
| 2,771,042 | 11/1956 | Deaton | 109/64 |
| 2,942,839 | 6/1960 | Smith | 251/299 X |

*Primary Examiner*—Jacob Shapiro
*Attorney, Agent, or Firm*—David A. Veeder

[57] ABSTRACT

A device for controlling the flow of water between an irrigation ditch and an adjacent field. A conduit having a first end opening into the irrigation ditch and a second end opening into the field to be irrigated. The cover is pivotally attached to the first end of the conduit by means of a "J"-shaped hinge. A handle is provided on the exterior of the cover and can be engaged by a manually-held instrument to pivot the cover to a position above the conduit where it will rest due to the configuration of the hinge part. The conduit is positioned relative to the irrigation ditch such that the first end is recessed inwardly of one side wall of the ditch and extends below the bottom wall of the ditch.

5 Claims, 4 Drawing Figures

Fig. 1
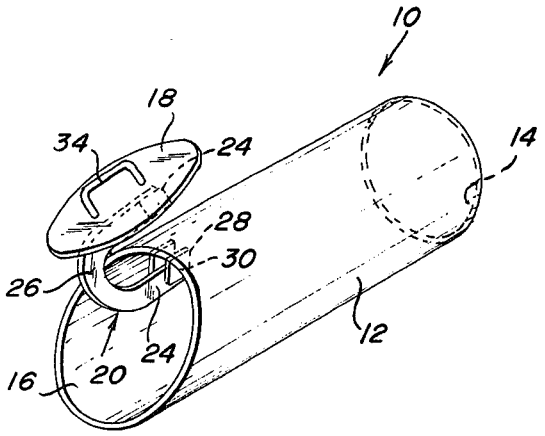
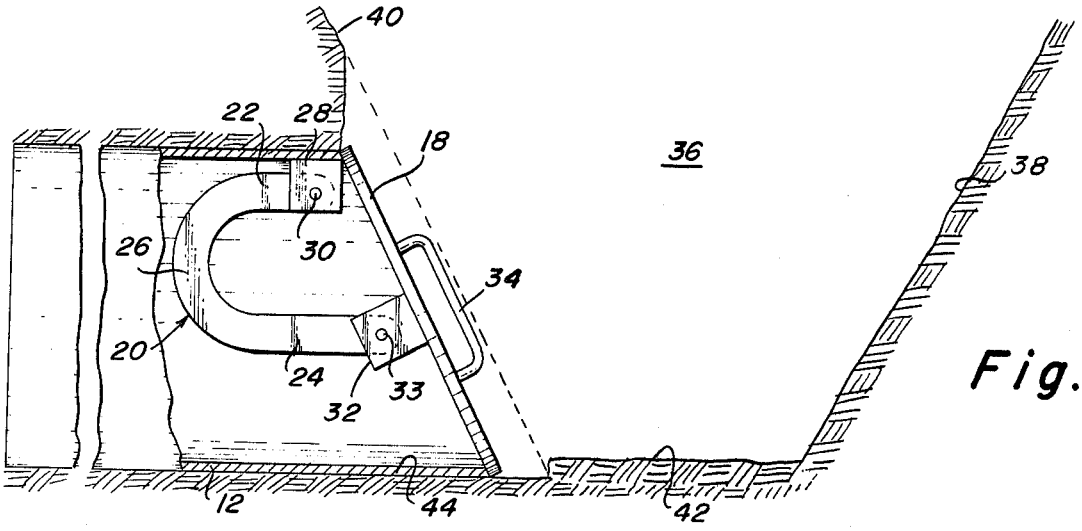
Fig. 2
Fig. 3
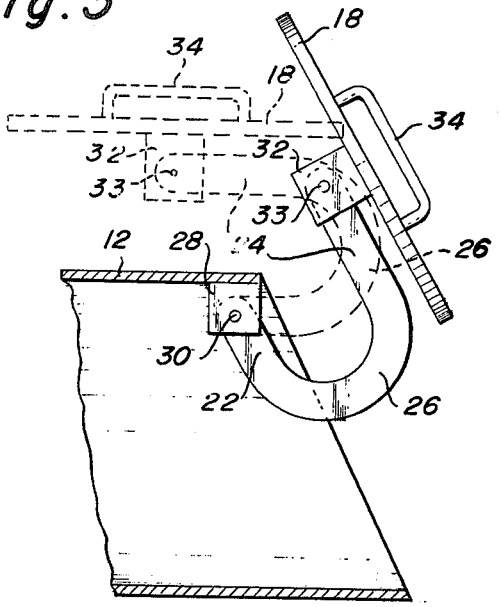
Fig. 4
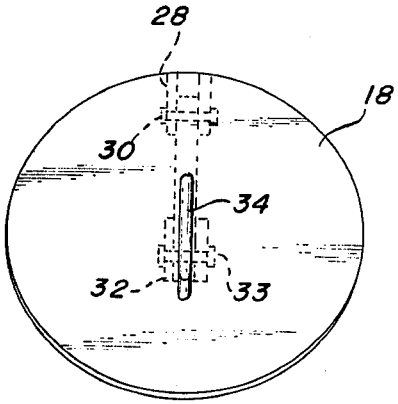

FLOW CONTROL DEVICE FOR AN IRRIGATION DITCH

This invention relates to a device for controlling the flow of water between an irrigation ditch and an adjacent field.

Many prior art devices for controlling water flow between an irrigation ditch and an adjacent field include external means for actuating cover plates or valves usually in the form of linkages or other protrusions which extend above the ground surface or along the side walls of the irrigation ditch thereby interfering with machinery traversing the banks of the ditch or machinery used to clear and plow the ditch. Illustrative of such devices are U.S. Pat. No. 1,612,467 to Meyers, dated Dec. 18, 1926, entitled HEAD GATE FOR IRRIGATION PURPOSES, U.S. Pat. No. 2,854,813 to Fisher, dated Oct. 7, 1958, entitled IRRIGATION DITCH VALVE and U.S. Pat. No. 2,688,461 to Simpson, dated Dec. 7, 1954, entitled VALVE FOR IRRIGATION SIPHON CONDUITS.

It is an objective of this invention to provide a simplified device for controlling water flow between an irrigation ditch and an adjacent field.

It is a further objective of this invention to provide a flow control device which has a minimum number of moving parts and which must be operated by a manually held but separate instrument such that in its normal position in the ground adjacent to the ditch, there are no protruding actuating elements which would tend to interfer with ground equipment or ditch cleaning equipment.

Further, it is an objective of this invention to place the flow control device in the ground adjacent to the irrigation ditch in a manner such that the inlet end communicating with the ditch and the cover or valve, therefore, is recessed inwardly of the side wall of the ditch. Further, the lowermost portion of the conduit is positioned below the floor of the ditch. Accordingly, the flow control device in no way interfers with machinery used to clear the ditch of debris and weeds.

In a preferred embodiment of the flow control device of this invention a conduit is positioned in the ground extending between the irrigation ditch and an adjacent field. The inlet end communicates with the ditch and the outlet end communicates with the field. A cover plate is provided for the inlet end used and is hingedly connected to the conduit by means of a "J"-shaped hinge bar having a first leg and a second leg which is longer than the first leg. A curvilinear portion joins the first and second leg. The short leg is pivotally connected at its free end to the upper roof of the conduit and the free end of the longest or second leg is pivotally connected to the rear side of the cover plate. A projection or handle is provided on the exterior of the cover plate to be engaged by a manually held instrument to lift the cover plate on its hinge away from the end of the conduit into a position overlying the conduit whereupon water can flow unobstructed through the inlet to the field to be irrigated. The shape of the hinge bar is such that the cover plate will hold its open position above the conduit. This is due to the length of the "J" bar and the weight distribution of the cover relative to the position of the "J" bar.

These and other objects of the invention will become more apparent to those skilled in the art by reference to the following detailed description when viewed in light of the accompanying drawings wherein:

FIG. 1 is a perspective view of the flow control device of this invention;

FIG. 2 is a cross sectional view of the flow control device of this invention showing the device in place adjacent an irrigation ditch;

FIG. 3 is a side view in elevation showing the device of this invention in the open position; and FIG. 4 is an end view showing the exterior of the cover plate.

Referring now to the figures wherein like numerals indicate like parts, the numeral 10 generally indicates the flow control device of this invention which comprises a conduit section 12, an outlet end 14 and an inlet end 16. The inlet end may be tapered as shown in the drawings to correspond to the sloping side wall of a "V"-shaped irrigation ditch. A cover plate 18 is hinged to the conduit section 12 by means of a "J"-shaped hinge bar 20. The bar consists of a first leg portion 22 and a second leg portion 24 which is longer than the first leg portion 22, and a curvilinear section 26 which joins the leg portions. The free end of the leg portion 22 is pivotally connected to an interior roof section of the conduit by means of bracket 28 and pin 30. The bracket may be welded or otherwise firmly affixed to the conduit section. A similar bracket 32 is affixed to the rear interior side of the cover plate 18 and the free end portion of leg 24 is pivotally attached to the bracket and hence the cover plate by means of pivot pin 33.

A handle or projection 34 is affixed to the exterior surface of the cover plate and is engaged by a manually held device such as a rod with ahook on the end whereby a person standing on the edge of the irrigation ditch can reach down with the hook and lift the cover plate to the open position. FIG. 3 shows the cover plate in the partially open position, with the fully open position being illustrated by broken lines.

FIG. 2 shows the flow control device of this invention in place adjacent an irrigation ditch 36 which has tapered side walls 38 and 40 and a floor 42. As mentioned earlier, the inlet end 16 of the flow control device is tapered to correspond generally to the tapered side wall of the irrigation ditch. It is important to note that the inlet end 16 and the cover plate 18 are recessed in the side wall 40 of the irrigation ditch 36. A continuation of the side wall is illustrated by the dotted line and as can be seen, the cover plate including the handle 34 lie within that dotted line. Accordingly, an irrigation ditch plow or other machinery used to clean out the ditch can be utilized without fear of damaging the flow control device. However, a notch or recess has to be cut into the wall of the ditch just above the device to permit the cover plate to be swung to the fully open position. Further, it is to be noted that the bottom of the conduit lies below the floor of the ditch. This increases fluid flow and insures maximum drainage.

The cover and conduit end are machined such that an effective seal is made between the two without the need for a gasket. If a gasket is not used, the weeds in the ditch can be removed by burning without fear of damaging the flow control device.

Only one conduit section is shown, however, it is to be understood that a number of tubular sections may be connected to the outlet end 14 depending upon the distance between the field to be irrigated and the irrigation ditch 36.

In operation, an attendant merely walks along the edge of the ditch and reaches down with a hooked instrument to engage the handle 35 and lift the cover plate into the position shown in FIG. 1. Due to the configuration of the hinge and the weight distribution of the cover plate and hinge relative to the conduit section, the cover plate will maintain the open position shown in FIG. 1 until again moved to the closed position by an attendant. It can be seen that the device of this invention is more simplified relative to prior art devices and eliminates the external obstructions caused by the linkages or the like used in the prior art to actuate the flow control devices.

In a general manner, while there has been disclosed an effective and efficient embodiment of the invention, it should be well understood that the invention is not limited to such an embodiment as there might be changes made in the arrangement, disposition, and form of the parts without departing from the principle of the present invention as comprehended within the scope of the accompanying claims.

I claim:

1. A device for controlling water flow from an irrigation ditch to an adjacent field comprising, a conduit having an inlet end opening into said field, a cover for said inlet end moveable between a closed position and an open position, hinge means connecting said cover to said conduit for movement between said open and closed positions, said cover when in said open position being disposed above the inlet end of said conduit, said hinge means comprising a "J"-shaped bar which is pivotably attached at one end to the inner top portion of said inlet end of said conduit and attached at the other end to said cover.

2. The device of claim 1 wherein said inlet end is tapered, and said cover is of an oval configuration to mate with and seal said inlet end.

3. The device of claim 2 and including a projection on the exterior of said cover, said projection being engageable by manually held means to open said cover.

4. The device of claim 1 wherein said "J" bar has a first leg, a second leg parallel to said first leg and being longer than said first leg, and a curvilinear portion joining said legs, the end of said first leg being pivotally attached to the inner top portion of said inlet end of said conduit, said cover being pivotally attached to the end of said second leg, and said legs being disposed in a horizontal position when said cover is in the closed position.

5. The device of claim 1 wherein said ditch has a side wall and said inlet end is recessed within said side wall.

* * * * *